US009873554B2

(12) United States Patent
Choltco-Devlin

(10) Patent No.: US 9,873,554 B2
(45) Date of Patent: Jan. 23, 2018

(54) ONE-HANDED CAM LID WITH REMOVABLE SEALING ELEMENT FOR DRINKING VESSEL

(71) Applicant: Pacific Market International, LLC, Seattle, WA (US)

(72) Inventor: Evan M. Choltco-Devlin, Seattle, WA (US)

(73) Assignee: Pacific Market International, LLC, Seattle, WA (US)

( * ) Notice: Subject to any disclaimer, the term of this patent is extended or adjusted under 35 U.S.C. 154(b) by 0 days.

(21) Appl. No.: 14/951,225

(22) Filed: Nov. 24, 2015

(65) Prior Publication Data

US 2017/0144808 A1 May 25, 2017

(51) Int. Cl.

| | |
|---|---|
| ***A47G 19/22*** | (2006.01) |
| ***B65D 47/04*** | (2006.01) |
| ***B65D 43/26*** | (2006.01) |
| ***B65D 43/02*** | (2006.01) |
| ***B65D 39/00*** | (2006.01) |
| ***B65D 45/16*** | (2006.01) |

(Continued)

(52) U.S. Cl.

CPC ..... *B65D 43/26* (2013.01); *A47G 19/2272* (2013.01); *B65D 39/0052* (2013.01); *B65D 43/02* (2013.01); *B65D 45/16* (2013.01); *B65D 51/18* (2013.01); *B65D 47/249* (2013.01); *B65D 2251/009* (2013.01); *B65D 2251/0012* (2013.01); *B65D 2251/0028* (2013.01); *B65D 2251/0081* (2013.01); *B65D 2543/00046* (2013.01)

(58) Field of Classification Search

CPC .... B65D 43/26; B65D 43/02; B65D 39/0052; B65D 45/16; B65D 51/18; B65D 2251/0012; B65D 2251/0028; B65D 2251/0081; B65D 2251/009; B65D 2543/00046; B65D 47/249; A47G 19/2272; A47J 41/0022; A47J 41/0027

USPC ..... 222/511, 559, 518, 149, 531, 148, 151, 222/153.13; 220/715, 254.5, 264, 254.9, 220/212.5, 756, 255, 502, 262, 281, 832; 215/244, 315, 387

See application file for complete search history.

(56) References Cited

U.S. PATENT DOCUMENTS 1,046,803 A * 12/1912 Kendall ..... B65D 47/286 222/511

3,256,916 A * 6/1966 Silletti ..... B67C 11/04 141/100

(Continued)

*Primary Examiner* — J. Gregory Pickett

*Assistant Examiner* — Gideon Weinerth

(74) *Attorney, Agent, or Firm* — George C. Rondeau, Jr.; Davis Wright Tremaine LLP

(57) ABSTRACT

A lid and a removable sealing assembly are provided for use in an integrated configuration where the sealing assembly is secured to the lid. The sealing assembly may be separated from the lid in a cleaning configuration that facilitates thorough cleaning of the lid and the sealing assembly. The lid includes a trigger assembly selectively operable to engage with the sealing assembly to unseal a drinking aperture on the lid when the lid and sealing assembly are in the integrated configuration. The sealing assembly includes guide members that are configured to engage with respective guide tracks on the lid in the integrated configuration. A latching portion of the sealing assembly secures the sealing assembly to a support lip of the lid in the integrated configuration.

28 Claims, 7 Drawing Sheets

(51) Int. Cl.
*B65D 51/18* (2006.01)
*B65D 47/24* (2006.01)

(56) References Cited

U.S. PATENT DOCUMENTS 3,964,631 A * 6/1976 Albert ..... B65D 47/249 220/254.3
3,967,748 A * 7/1976 Albert ..... B65D 47/249 215/307
3,972,443 A * 8/1976 Albert ..... B65D 47/249 220/254.5
4,099,642 A * 7/1978 Nergard ..... A47G 19/2272 220/254.5
5,169,016 A * 12/1992 Hinz, Jr. ..... B65D 47/2037 220/203.29
5,203,468 A * 4/1993 Hsu ..... A47G 19/2272 220/254.3
5,325,998 A * 7/1994 Bennett ..... A47K 5/1214 222/173
5,427,271 A * 6/1995 Wang ..... A47G 19/2272 220/255
5,495,966 A * 3/1996 Won ..... F16K 31/52 220/714
6,098,834 A * 8/2000 Hatsumoto ..... B65D 47/249 220/212.5
6,116,476 A * 9/2000 Huang ..... B65D 47/249 222/506
D651,847 S 1/2012 Gilbert
8,360,258 B2 * 1/2013 Gilbert ..... A47G 19/2272 220/203.05
8,573,431 B2 * 11/2013 Shepard ..... A47G 19/2272 215/315
8,727,176 B2 * 5/2014 El-Saden ..... A47G 19/2272 215/228
8,746,496 B2 * 6/2014 Gilbert ..... A47G 19/2272 215/236
8,844,762 B2 * 9/2014 Chiou ..... B65D 43/02 215/305
8,863,979 B2 * 10/2014 El-Saden ..... A47G 19/2272 220/254.1
8,978,923 B2 * 3/2015 George ..... A47G 19/2272 215/311
9,462,904 B2 * 10/2016 Coon ..... A45F 3/18
2012/0031902 A1 2/2012 Gilbert
2012/0325815 A1 * 12/2012 Gilbert ..... A47G 19/2272 220/264
2014/0197170 A1 * 7/2014 Carlile ..... B65D 47/249 220/262
2015/0201776 A1 * 7/2015 Elsaden ..... A47G 19/2272 220/715
2016/0106241 A1 * 4/2016 Wong ..... A47G 19/2272 220/254.5
2016/0264312 A1 * 9/2016 Choltco-Devlin . B65D 47/0895

* cited by examiner

ONE-HANDED CAM LID WITH REMOVABLE SEALING ELEMENT FOR DRINKING VESSEL

FIELD OF INVENTION

The present invention relates to removable lids for drinking vessels and more precisely to one-handed cam lids having a removable sealing element.

BACKGROUND

The following description includes information that may be useful in understanding the present invention. It is not an admission that any of the information provided herein is prior art or relevant to the presently claimed invention, or that any publication specifically or implicitly referenced is prior art.

Drinking vessels with lids having sealing mechanisms are known in the art. U.S. Pat. No. 8,727,176 discloses a seal mechanism for a drinking vessel that is movable between a cleaning position and a use position. U.S. Pat. No. 8,360,258 discloses a lid assembly having a main body to which a stopper cap and stopper cover may be attached.

DETAILED DESCRIPTION

Figure 1A:
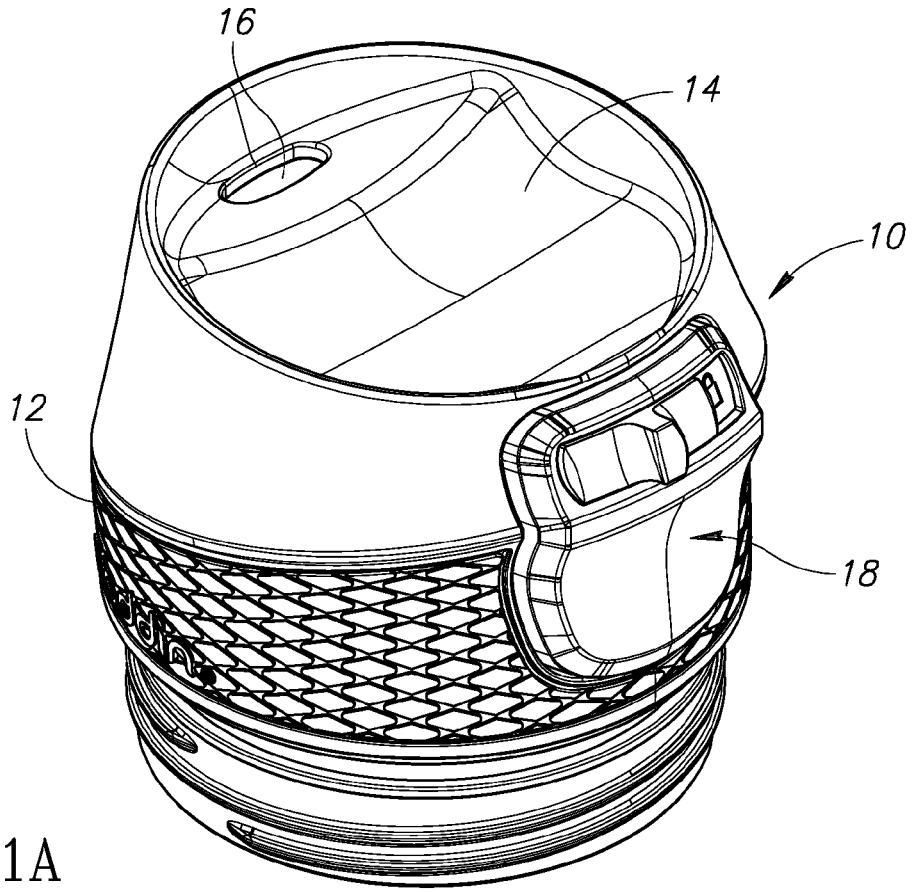
FIG. 1A illustrates a top perspective view of a drinking vessel lid.
Figure 1B:
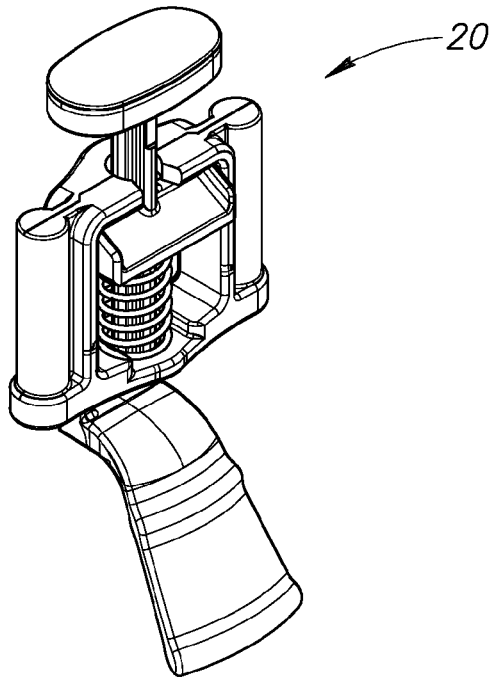
FIG. 1B illustrates a sealing element used with the drinking vessel lid of FIG. 1A.

A lid 10 in accordance with the present embodiment is shown in FIG. 1A. The lid 10 has a substantially cylindrical main body 12 with an upper portion 14. The upper portion 14 has an elongated drinking aperture 16 through which liquid may flow. A trigger assembly 18 is operable to seal and unseal the drinking aperture 16. A sealing assembly 20 is shown in FIG. 1B removed from the lid 10 and which may be selectively installed in the lid, as shown in FIGS. 4A-4D. When the sealing assembly 20 is installed in the lid 10, the sealing assembly may interact with the trigger assembly 18 to seal and unseal the drinking aperture 16. The sealing assembly 20 may be separated from the lid 10, as shown in FIG. 1B, to more thoroughly clean the parts than when the sealing assembly 20 is installed in the lid 10. That is, when the sealing assembly 20 is separated from the lid 10, particles and residue may be thoroughly removed from the crevices and other hard to reach areas of both the lid 10 and the sealing assembly 20.

Figure 2A:
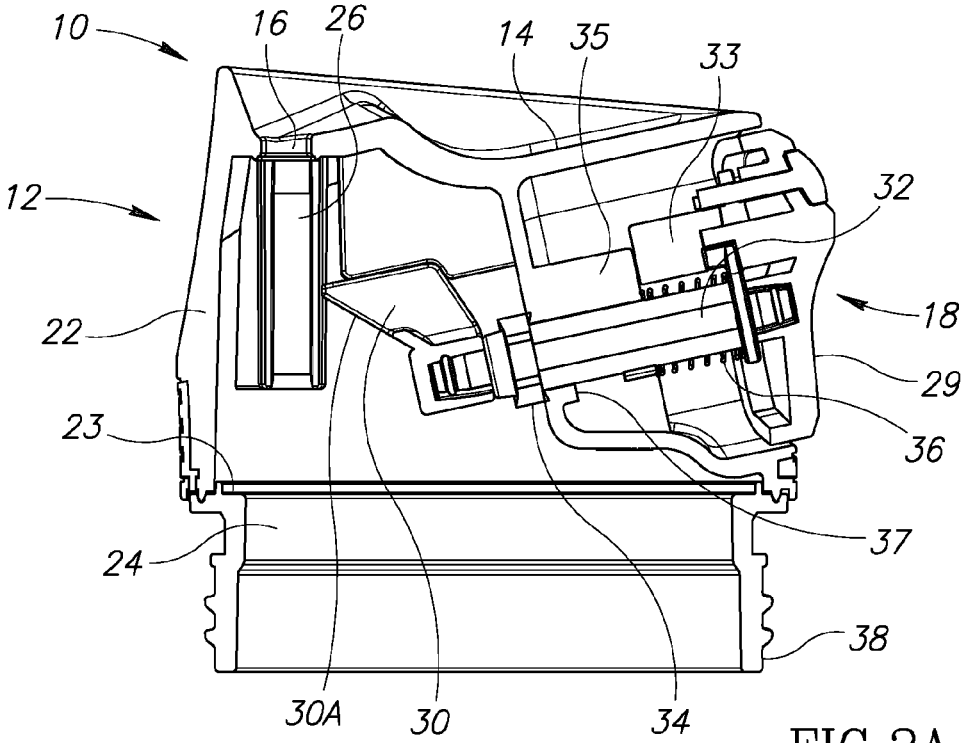
FIG. 2A illustrates a cross-sectional left side view of the drinking vessel lid of FIG. 1A with the sealing element removed.
Figure 2B:
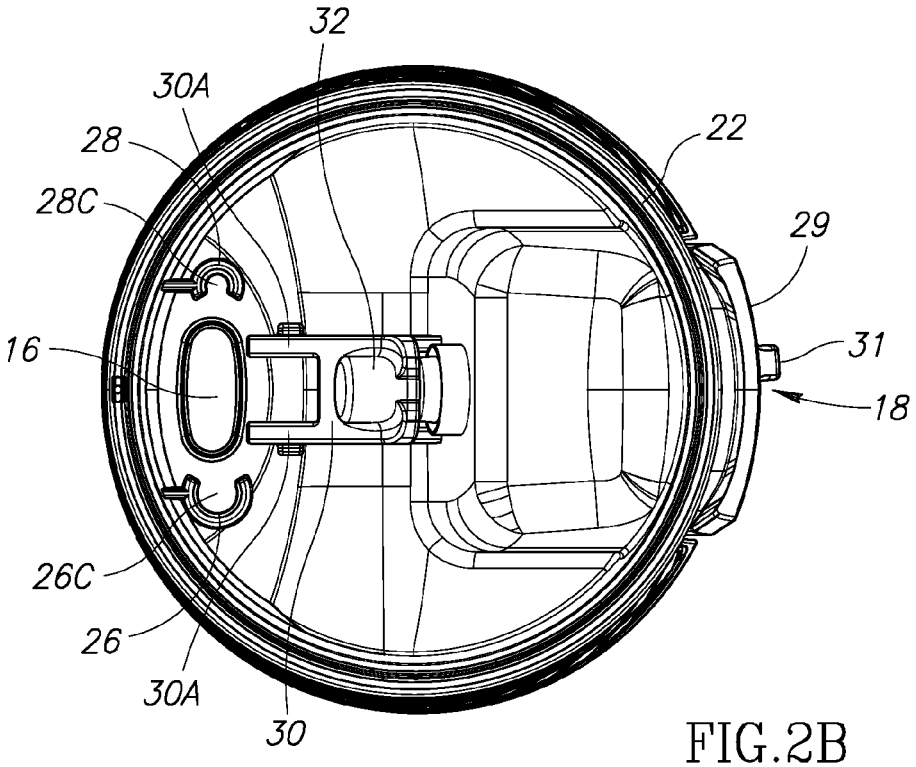
FIG. 2B illustrates a bottom plan view of the drinking vessel lid of FIG. 1A with the sealing element removed.
Figure 5:
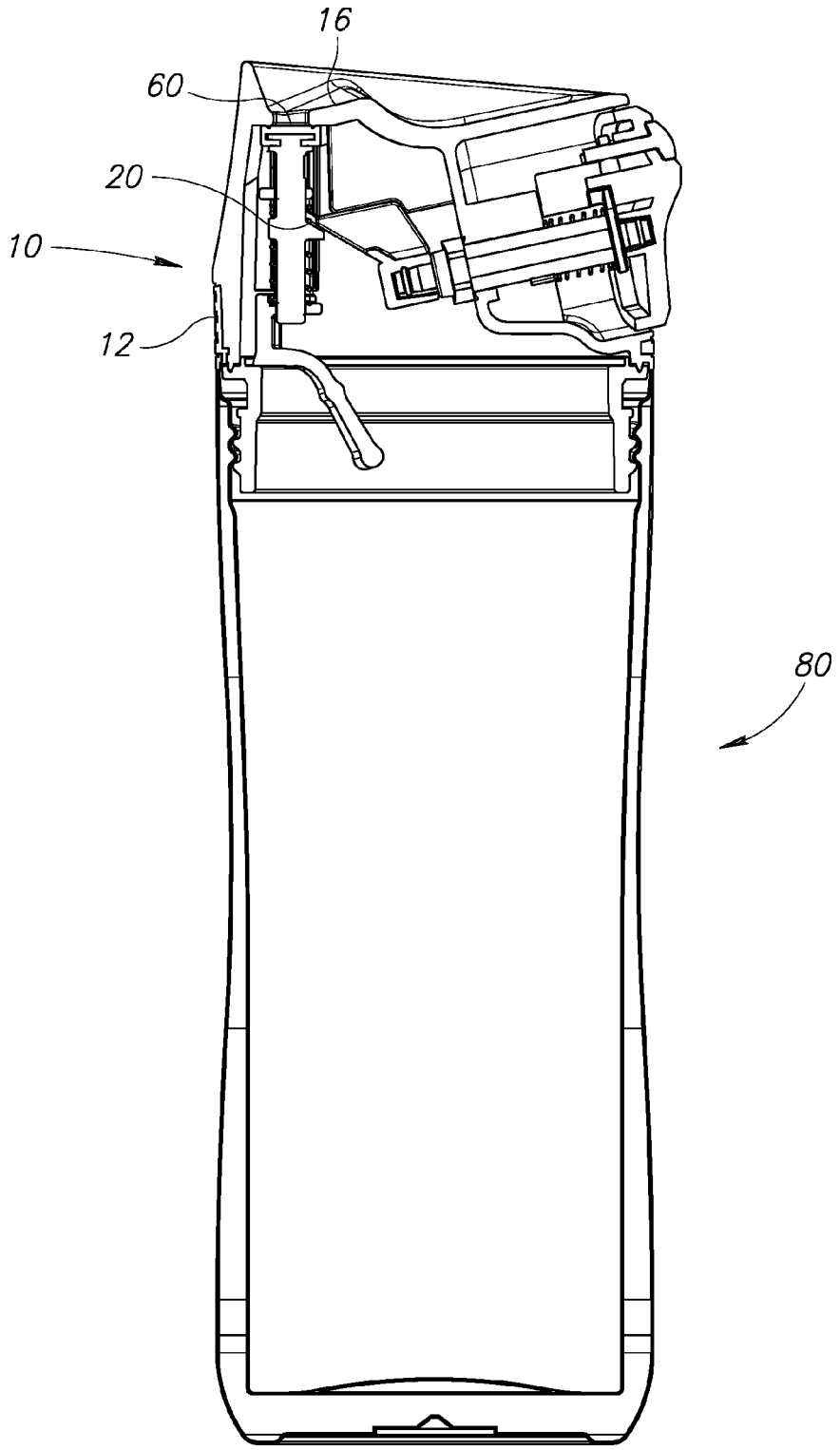
FIG. 5 illustrates a cross-sectional left side view of the integrated configuration of FIG. 4A attached to a drinking vessel.

Referring to FIG. 2A, the main body 12 includes circumferentially extending sidewalls 22 which extend downward from the upper portion 14 to form a downwardly opening open-ended cavity 24. A first guide track 26 extends downwardly from the upper portion 14 on one side of the drinking aperture 16. A second guide track 28 extends downwardly from the upper portion 14 on a side of the drinking aperture 16 opposite to the first guide track portion 26 (see FIG. 2B). The first guide track 26 has a concave portion 26C that faces a concave portion 28C of the second guide track 28. The first guide track 26 and the second guide track 28 are configured to slidably receive and mate with the sealing assembly 20. The first guide track 26 preferably has a different size and/or shape than the second guide track 28. The first guide track 26 and the second guide track 28 are offset from a center of the lid main body 12 at an interior side of the sidewall 22. A support lip 23 is provided on an interior peripheral surface of the sidewall 22 with which the sealing assembly 20 may be engaged and retained thereby. The lid 10 has a threaded attachment portion 38 that may threadably attach to a drinking vessel 80, as shown in FIG. 5. Other attachment means may be used to removably join the lid 10 to the drinking vessel 80 in a fluid-tight configuration, such as a bayonet mount or friction fit, and may include an O-ring or gasket sized to seal the lid 10 to the drinking vessel 80.

The trigger assembly 18 includes a trigger portion 29, an actuator portion 30, a shaft 32, a trigger seal 34, and a first elastic element 36. The trigger assembly 18 is provided for selectively engaging the sealing assembly 20 to unseal the drinking aperture 16, as described below. The trigger portion 29 is exposed on an exterior surface of the sidewalls 22. The shaft 32 is a rigid body that extends between the trigger portion 29 and the actuator portion 30. The shaft 32 is slidably movable back and forth through a trigger aperture 37 on a side of the trigger assembly 18 toward the downwardly opening cavity 24. The trigger portion 29 is disposed on a first end of the shaft 32 and is operable to move the shaft 32 inward when pressed inward. The actuator portion 30 is disposed on a second end of the shaft 32 opposite to the first end of the shaft 32. The trigger seal 34 is mounted on the shaft 32 at a fixed position on the shaft.

When the sealing assembly 20 is installed in the lid 10, the actuator portion 30 may interact with the sealing assembly to unseal the drinking aperture 16. In a resting position where the trigger portion 29 is not pressed, the first elastic element 36 pushes the shaft 32 in a direction away from the first guide track 26 and the second guide track 28 (and the sealing assembly 20 when installed in the lid 10). The first elastic element 36 is preferably a compression coil spring, but may instead be any elastically deformable element that provides a sufficient force to return the trigger portion to a resting position. The trigger seal 34 assists in forming a fluid-tight seal of the trigger aperture 37 when the trigger assembly 18 is in the resting position. The trigger seal 34 is preferably a rubber or an elastic polymer material that may flex against the surface around the trigger aperture 37 to aid in forming the fluid-tight seal.

When the trigger portion 29 is pressed, the shaft 32 moves the actuator portion 30 in an inward direction toward the first guide track 26 and second guide track 28. Initial movement of the shaft 32 in the inward direction separates the trigger seal 34 from the trigger aperture 37 allowing the trigger aperture to pre-vent the pressure and steam within the drinking vessel 80 (see FIG. 5). Continued inward pressing of the trigger portion 29 actuates the sealing assembly 20 to unseal and open the drinking aperture 16 for drinking. The trigger assembly 18 may be provided with a locking switch 31 that selectively prevents the trigger assembly from engaging with the sealing assembly 20. In particular, the locking switch 31 may selectively position a block 33 between an inner wall 35 and the trigger portion 29, preventing the trigger portion 29 from moving further inward and actuating the sealing assembly 20.

Figure 3A:
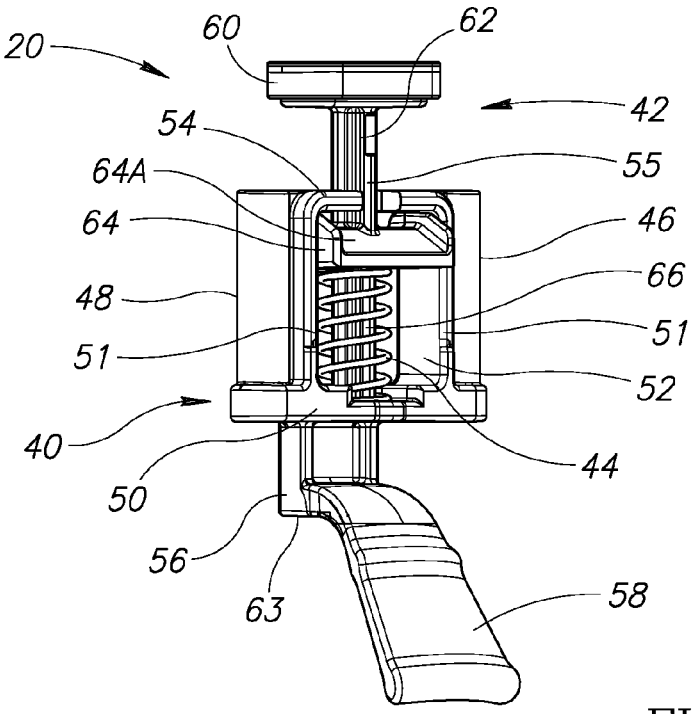
FIG. 3A illustrates a back perspective view of the sealing element of FIG. 1B.
Figure 3B:
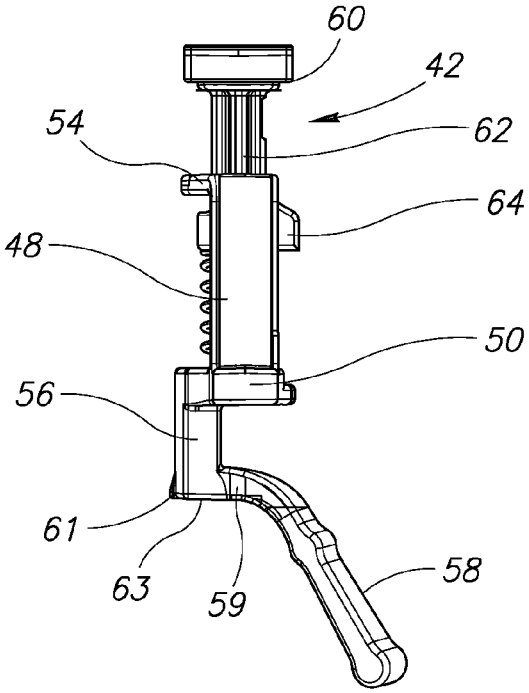
FIG. 3B illustrates a left side view of the sealing element of FIG. 1B.
Figure 3C:
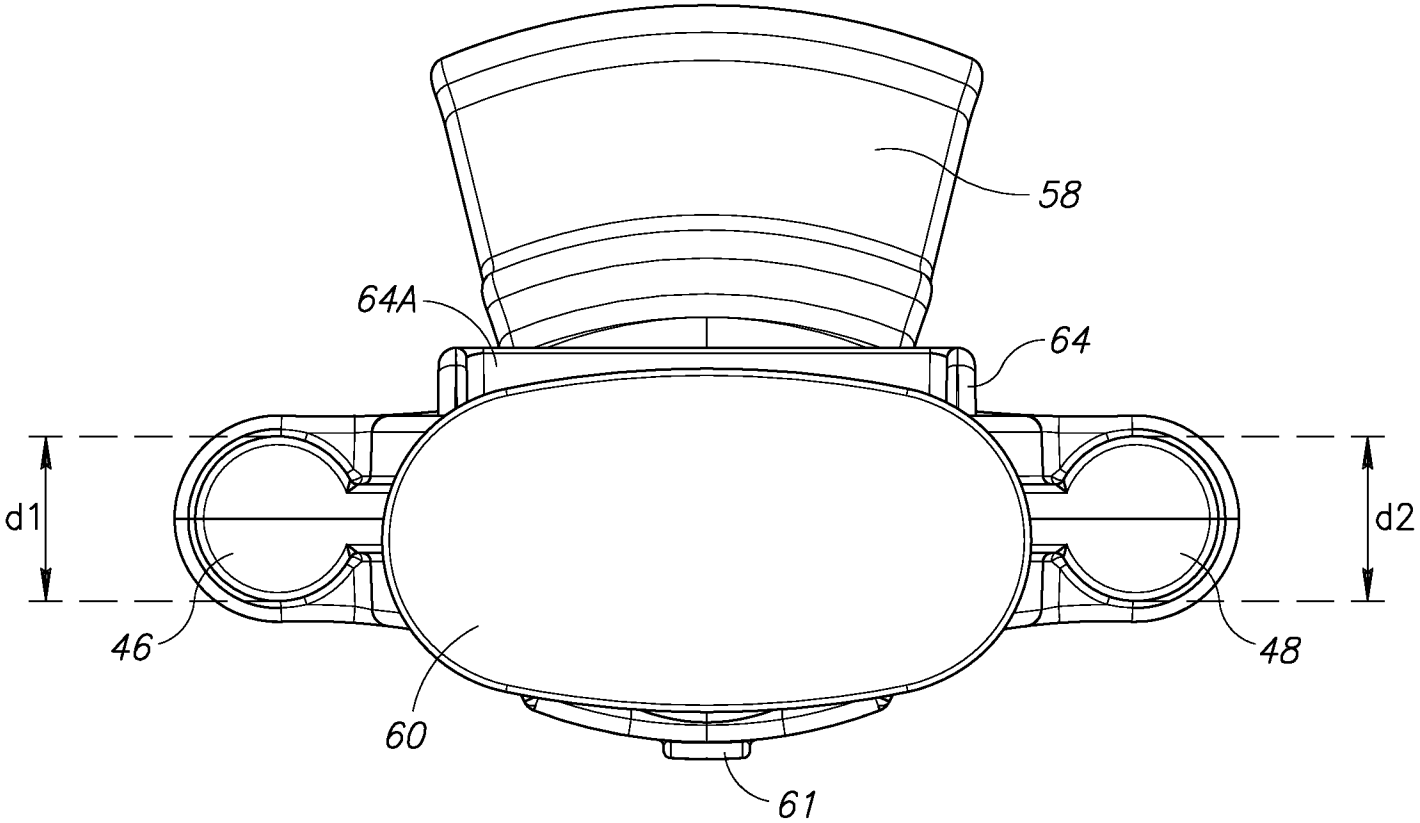
FIG. 3C illustrates an enlarged top plan view of the sealing element of FIG. 1B.

Referring to FIG. 3A, the sealing assembly 20 includes a sealing assembly body 40, a sealing element 42, and a second elastic element 44. A first guide member 46 and a second guide member 48 are provided on opposite lateral sides of the sealing assembly body 40, as shown in FIGS. 3A-3C. The sealing assembly body 40 includes a transverse base portion 50 and a transverse upper portion 54. The first guide member 46 and second guide member 48 extend between the base portion 50 and the upper portion 54. The first guide member 46 preferably has a different size and/or shape than the second guide member 48 for reasons discussed below (e.g., d1 is not equal to d2, as shown in FIG. 3C).

Spaced apart first and second members 51 extend between the base portion 50 and the upper portion 54. Each member 51 has a laterally inward facing inner sidewall 52. The inner sidewalls 52 extend in parallel as do the first guide member 46 and the second guide member 48. A centrally located through-hole upper aperture 55 extends through the upper portion 54 (see FIGS. 3A, and 4A-4C) and a centrally located through-hole lower aperture 57 extends through the base portion 50 (see FIGS. 4A and 4C). The sealing assembly 20 further includes a latching portion 56 extending downwardly from the base portion 50, as shown in FIG. 3B. The latching portion 56 may have a protrusion 61 on an outward side. A gripping tab 58 is attached to the latching portion 56 to facilitate a user inserting the sealing assembly 20 into and removing the sealing assembly from the lid 10. The gripping tab 58 extends downward and inward from the sealing assembly body 40. The latching portion 56 preferably has sufficient flexibility that it may be flexed by the user holding the gripping tab 58 to facilitate insertion and removal of the sealing assembly 20 to and from the interior of the lid main body 12, as described in detail below. An inwardly extending portion 59 to which the gripping tab 58 is connected may be provided below the base portion 50 to position the gripping tab away from the sidewall 22.

The sealing element 42 is slidably supported and guided by the sealing assembly body 40. The sealing element 42 has an upper support shaft or member 62 that may slidably move up and down within the upper aperture 55 and lower aperture 57 of the sealing assembly body 40. An upper end of the upper support member 62 terminates at a seal support platform that supports an elongated drinking aperture seal or stopper 60 which moves therewith. The drinking stopper 60 is sized and shaped to completely cover and seal the drinking aperture 16 when in a sealing position at the drinking aperture. A crossbar portion 64 is attached to the upper support member 62 at a location between the upper portion 54 and the base portion 50 of the sealing assembly body 40, and extends in a direction perpendicular to the upper support member 62 (i.e., laterally). The crossbar portion 64 preferably has a cam follower, i.e., an angled upper surface 64A that slopes upward and outward toward the sidewall 22. The crossbar portion 64 may extend laterally between and contact the sidewalls 52 thereby limiting rotation of the sealing element 42 and hence ensuring alignment of the drinking stopper 60 with the drinking aperture 16. A lower portion 66 of the support member 62, extending downward from the crossbar portion 64, extends through the second elastic element 44, which is positioned between the crossbar portion 64 of the sealing element 42 and the base portion 50 of the sealing assembly body 40. The lower portion 66 of the support member 62 extends into the lower aperture 57 of the base portion 50 of the sealing assembly body 40. When the trigger portion 29 is pressed inward, the support member 62 is moved downward extending the lower portion 66 of the support member 62 deeper into the lower aperture 57 resulting in a lower end portion of the lower portion 66 of the support member 62 protruding downward beyond the base portion 50, as shown in FIG. 4D.

The second elastic element 44 is preferably a compression coil spring that biases the crossbar portion 64 upward away from the base portion 50 and holds the drinking stopper 60 securely against the underside of the upper portion 14 to create a fluid-tight seal over the drinking aperture 16 when in the sealing position. Alternatively, the second elastic element 44 may be any elastically deformable element that provides a force to actuate the sealing element 42 upward. By way of non-limiting example, the second elastic element 44 may be a tension coil spring or elastic band that pulls the crossbar portion toward the upper portion 54 of the sealing assembly body 40.

Figure 4A:
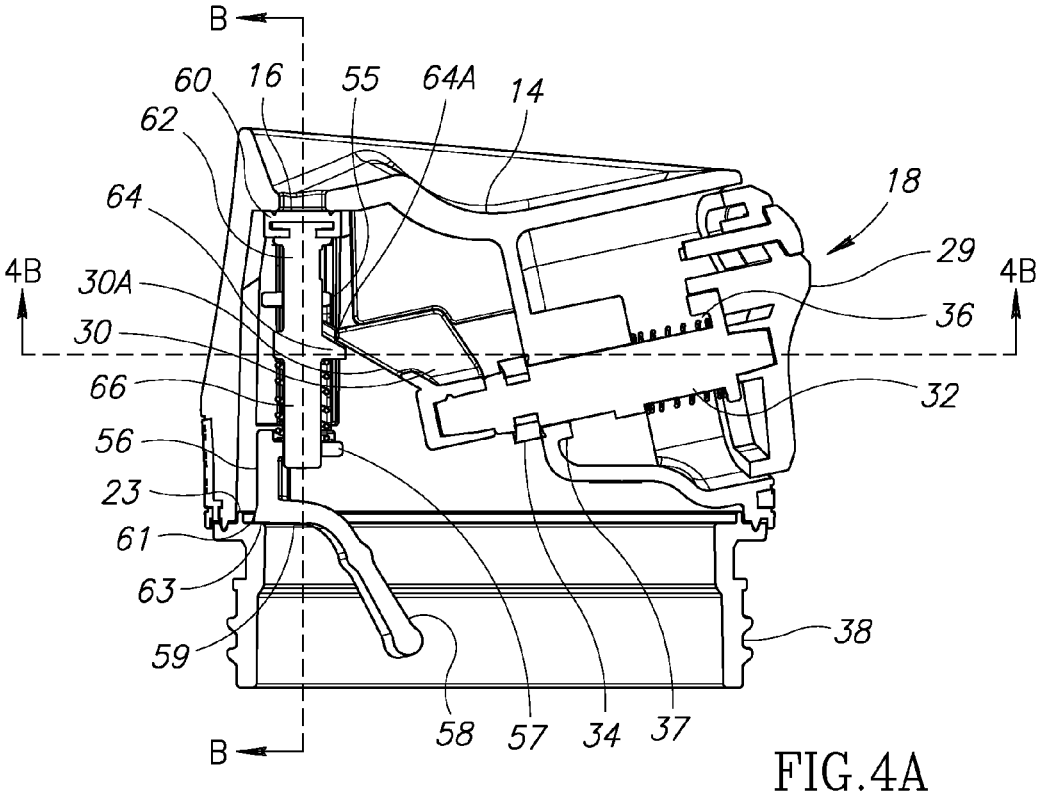
FIG. 4A illustrates a cross-sectional left side view the drinking vessel lid of FIG. 1A having the sealing element of FIG. 1B installed, and with a trigger assembly in a resting position.
Figure 4B:
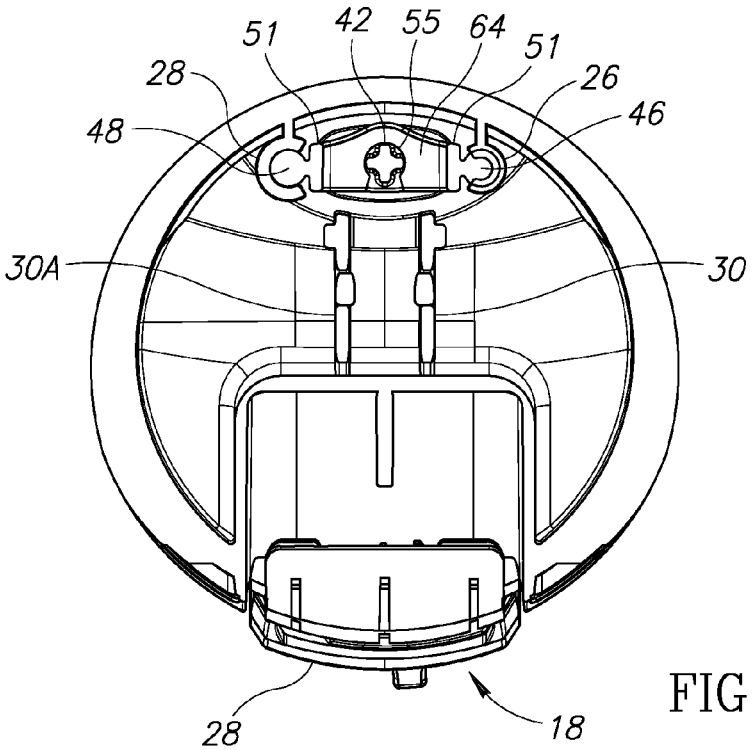
FIG. 4B illustrates a bottom plan, cross-sectional view of the integrated configuration of FIG. 4A taken substantially along line 4B-4B of FIG. 4A
Figure 4C:
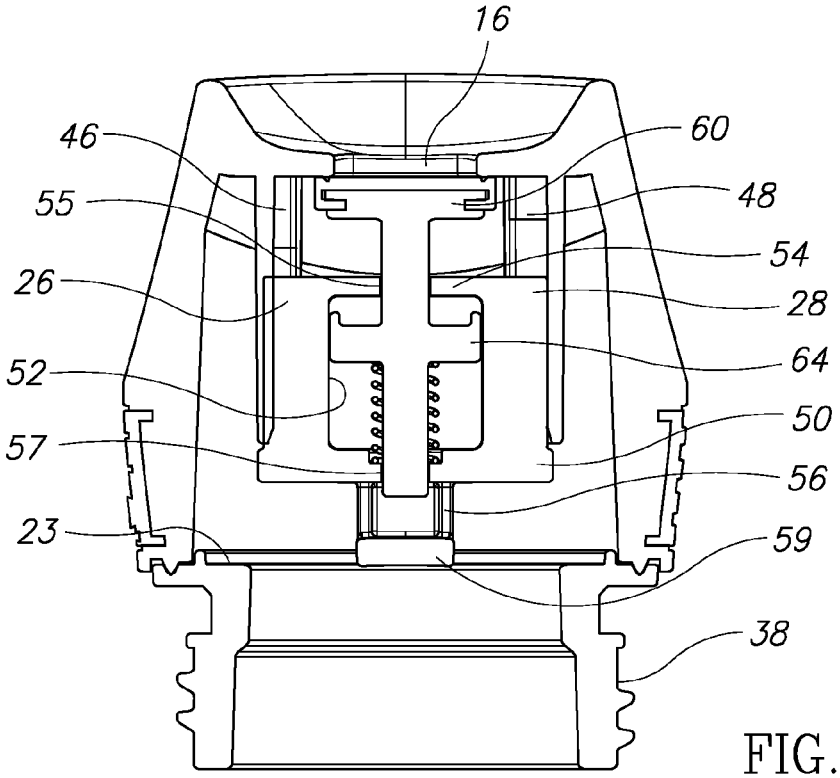
FIG. 4C illustrates a cross-sectional front view of the integrated configuration of FIG. 4A.
Figure 4D:
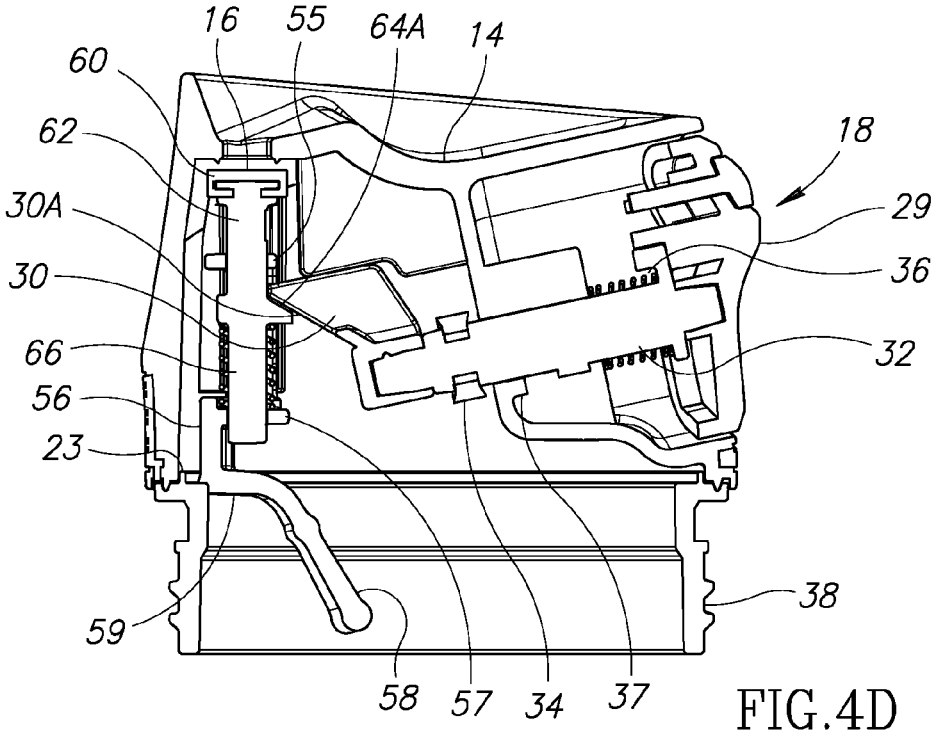
FIG. 4D illustrates a cross-sectional left side view of an integrated configuration of the sealing element and the drinking vessel lid of FIG. 1 with a trigger assembly in a deployed position.

The sealing assembly 20 may be removably mated with the lid main body 12 to form an integrated configuration of the lid 10, as shown in FIGS. 4A-4C. In the integrated configuration, the sealing assembly 20 is installed at a fixed position within the main body 12 and the trigger assembly 18 is operable to engage with the sealing element 42 to unseal the drinking aperture 16. To integrate the sealing assembly body 40 with the lid main body 12, the first guide member 46 and the second guide member 48 are simultaneously slidably inserted into the concave portion 26C of the first guide track 26 and the concave portion 28C the second guide track 28, respectively, as shown in FIGS. 4B-4C. The first guide member 46 is specifically sized and shaped (e.g., d1 shown in FIG. 3C) to match the size and shape of the first guide track 26, and to not match or mate with the second guide track 28. The second guide member 48 is specifically sized and shaped (e.g., d2 shown in FIG. 3C) to match the size and shape of the second guide track 28, and to not match or mate with the first guide track 26. Accordingly, the sealing element 20 may only be integrated with the lid main body 12 in an orientation where the first guide member 46 mates with the first guide track 26, and the second guide member 48 mates with the second guide track 28.

In some embodiments, the first guide track 26 does not have a concave portion 26C and/or the second guide track 28 does not have a concave portion 28C. As a non-limiting example of such a configuration, the first guide track 26 may have a convex portion instead of the concave portion 26C and/or the second guide track 28 may have a convex portion instead of the concave portion 28C. The first guide member 46 should have a shape complementing the first guide track 26 to facilitate a secure connection therebetween. Similarly, the second guide member 48 should have a shape complementing the second guide track 28 to facilitate a secure connection therebetween. The lid main body 12 and the sealing assembly 20 may be securely connected by only a single guide track and a single guide member; however, a more secure connection is provided by using two guide tracks respectively mated with two guide members.

As shown in FIG. 3C, the guide members and guide tracks have round complementary cross-sectional shapes. In other embodiments, the guide members and the guide tracks may have complementary interlocking cross-sectional shapes that also provide a secure connection and prevent lateral and/or forward/backward movement of the sealing assembly 20 within the lid 10. For example, the first guide member 46 and the first guide track 26 have first complementary interlocking shapes whereas the second guide member 48 and the second guide track 28 have different complementary interlocking shapes than the first guide member 46 and the first guide track 26. The complementary cross-sectional shapes are not particularly limited and may be a triangular shape, a "T" shape, or an "L" shape, by way of non-limiting example.

As the sealing assembly 20 is inserted into the lid main body 12, the latching portion 56 may flex inward, away from its original position as a result of the protruding portion 61 engaging the sidewall 22 below the support lip 23. Once the first guide member 46 and the second guide member 48 are fully inserted, the latching portion 56 of the sealing assembly 20is positioned above the support lip 23 of the lid main body 12 and reverts back to its original non-flexed position. In that position, a bottom surface portion 63 of the latching portion 56 extends over and abuts an upper surface of the support lip 23, thereby preventing the sealing assembly 20 from moving downward relative to the lid main body 12 during normal usage of the lid 10 for drinking fluid in the drinking vessel 80. To prevent the sealing assembly 20 from moving upward when the lid 10 is in the integrated configuration, the base portion 50 is sized to abut a bottom portion of the first guide track 26 and/or a bottom portion of the second guide track 28 (see FIG. 4C).

In some embodiments, the latching portion 56 may be part of the sealing assembly body 40 instead of being a part extending therefrom. By way of non-limiting example, the base portion 50 may be configured to interface with the support lip 23 to secure the sealing assembly 20 within the lid main body 12. Additionally, the gripping tab 58 may extend from the base portion 50 to facilitate insertion and removal of the sealing assembly 20 in a manner similar to that described herein. However, the latching portion 56 preferably extends from the base portion 50 of the sealing assembly 20, as shown in FIG. 3B, to facilitate insertion and removal of the sealing assembly 20 to and from the lid main body 12.

The supporting lip 23 shown in FIGS. 4A, 4B, and 4D extends around an inner peripheral surface of the lid main body 12. In some embodiments, the supporting lip 23 is instead only provided along the front side of the lid main body 12 to which the latching portion 56 engages. In further embodiments, the supporting lip 23 may be provided on a support member that extends downwardly from the upper portion 14. In such a configuration, the support lip 23 is not provided on downwardly extending sidewalls 22 and the latching portion 56 engages with the support lip 23 on the support member to secure the sealing assembly 20 to the lid main body 12.

When the lid 10 is in the integrated configuration and the trigger assembly 18 is in the resting position (i.e., not pressed), the drinking stopper 60 seals the drinking aperture 16. As shown in FIG. 4A, the trigger assembly 18 is positioned to engage with the sealing assembly 20. In particular, the actuator portion 30 of the trigger assembly 18 is proximate to or in contact with the upper surface 64A of the crossbar portion 64. The actuator portion 30 includes at least one angled cam member 30A with a length extending toward the sealing assembly body 40 which is sized and positioned to avoid contacting the upper support member 62, the drinking stopper 60, and the upper portion 54 when the sealing assembly 20 is inserted into the main body 12 so as to be in the integrated configuration for normal drinking operation. Once in the integrated configuration, the cam member 30A is positioned to engage only the upper surface 64A of the crossbar portion 64 during operation of the trigger assembly 18 to open the drinking aperture 16. In the present embodiment, two angled cam members 30A are offset toward lateral sides of the shaft 32 of the trigger assembly 18 (see FIG. 2B). Each cam member 30A has an angled edge lower surface 30B oriented at an angle complementary to an angle of the angled upper surface 64A of the crossbar portion 64. The trigger portion 29 is operable to press the angled edge lower surface 30B against the angled upper surface 64A and toward the adjacent portion of the sidewall 22, pushing the crossbar portion 64 and the sealing element 42 downward, as shown in FIG. 4D. The downward movement of the crossbar portion 64 separates the drinking stopper 60 from the drinking aperture 16, thereby unsealing the drinking aperture and allowing fluid to flow therethrough. The two cam members 30A are positioned so that the upper support member 62 is located therebetween to avoid its interference with operation of the trigger assembly 18.

The sealing assembly 20 may be removed from the lid main body 12 to provide a cleaning configuration in which the sealing assembly and lid main body may be thoroughly cleaned by hand or in a dishwasher. More precisely, particulate and liquid residue may be thoroughly and easily removed from the features of the lid main body 12 and the sealing element 20 when the sealing assembly is separated from the lid main body. To remove the sealing assembly 20 from the lid main body 12, a user may pull the gripping tab 58 inward from the support lip 23 with which the latching portion 56 interfaces and then downward. Pulling downwardly on the gripping tab 58, the user may then extract the first guide member 46 and the second guide member 48 of sealing element 20 from the first guide track 26 and the second guide track 28, respectively.

In FIG. 5, the lid 10 is shown attached to the drinking vessel 80 with the sealing assembly 20 in an integrated configuration with the lid main body 12. The upper portion drinking stopper 60 is pressed against the inward surface portion of the upper portion 14 about the drinking aperture 16 to help prevent heat and liquid from escaping through the drinking aperture.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare statement of "two recitations," without other modifiers, typically means at least two recitations, or two or more recitations).

What is claimed is:

1. A lid assembly for a drinking vessel, comprising:

a lid main body having a lid upper portion provided with a drinking aperture, a first guide track and a second guide track extending in a downward direction away from the drinking aperture;

a trigger assembly provided with a trigger portion and an actuating portion, the trigger portion configured to move the actuating portion when the trigger portion is pressed; and a removable sealing assembly provided with a sealing assembly body and a sealing element, the sealing assembly body having a first guide member and a second guide member, each extending along a first axis of the sealing assembly body, the sealing element having a drinking stopper on a first end, and the sealing element being slidably movable back and forth relative to the sealing assembly body along the first axis between (i) a first position where the drinking stopper is spaced apart at a farthest distance away from the sealing assembly body, and (ii) a second position where the drinking stopper is a closest distance to the sealing assembly body, the sealing assembly being removably secured to the lid main body when the lid assembly is in an integrated configuration and the sealing assembly being separated from the lid main body in a cleaning configuration, the integrated configuration being a configuration where the first guide member is retained by the first guide track, the second guide member is retained by the second guide track, and the actuating portion is positioned to move the sealing element between the first position where the drinking stopper seals the drink aperture and the second position where the drinking stopper is spaced apart from the drink aperture, the first guide member and the first guide track having complementary interlocking cross-sectional shapes and the second guide member and the second guide track having complementary interlocking cross-sectional shapes, the first guide member being slidably engageable with the first guide track and slidable therealong for guiding movement of the first guide member as the sealing assembly is moved to change the lid assembly between the integrated and cleaning configurations, and the second guide member being slidably engageable with second guide track and slidable therealong for guiding movement of the first guide member as the sealing assembly is moved to change the lid assembly between the integrated and cleaning configurations.

2. The lid assembly of claim 1, wherein the first guide member of the sealing assembly is a different size than the second guide member of the sealing assembly, and the first guide track of lid main body is a different size than the second guide track of the lid main body, the first guide member being sized and shaped to match at least one of a size and a shape of the first guide track, and the second guide member being sized and shaped to match at least one of a size and a shape of the second guide track.

3. The lid assembly of claim 1, wherein the sealing assembly body including a base portion from which at least one of the first guide member and the second guide member extend, the base portion abutting a lowermost end of at least one of the first guide track and the second guide track when the lid assembly is in the integrated configuration.

4. The lid assembly of claim 1, further comprising:

a support lip disposed on the lid main body; and a latching portion disposed on the sealing assembly body, the latching portion being configured to engage with the support lip to removably secure the sealing assembly to the lid main body in the integrated configuration.

5. The lid assembly of claim 4, further comprising:

sidewalls extending away from the lid upper portion and defining an open ended cavity, the support lip being provided on a surface within the cavity.

6. The lid assembly of claim 4, wherein the latching portion is a flexible member extending away from the sealing assembly body along the first axis.

7. The lid assembly of claim 6, wherein the latching portion includes a gripping tab extending away from the flexible member, wherein the gripping tab is configured to flex the latching portion to facilitate insertion and removal of the sealing assembly from the lid main body.

8. The lid assembly of claim 4, wherein the sealing assembly body includes a base portion from which at least one of the first guide member and the second guide member extends, and when the sealing assembly is removably secured to the lid main body in the integrated configuration, the base portion abuts a lowermost end of at least one of the first guide track and the second guide track, and the latching portion contacts the support lip.

9. The lid assembly of claim 4, wherein the sealing assembly includes a gripping tab extending away from the sealing assembly body, the gripping tab configured to facilitate insertion and removal of the sealing assembly from the lid main body.

10. The lid assembly of claim 1, wherein the sealing element further includes a crossbar portion having an angled surface, the angled surface facing the actuating portion of the trigger assembly when the first guide member is engaged with the first guide track and the second guide member is engaged with the second guide track.

11. The lid assembly of claim 10, wherein the sealing assembly further comprises an elastic element adjacent to the crossbar portion to apply a biasing force on the crossbar portion to hold the drinking stopper in the first position sealing the drink aperture when the trigger portion is not pressed.

12. The lid assembly of claim 10, wherein the actuating portion of the trigger assembly includes an angled surface that has a complementary angle to the angled surface of the crossbar portion, and when the trigger portion is pressed, the angled surface of the actuating portion moving the crossbar portion of the sealing assembly downward and moving the sealing element from the first position to the second position.

13. The lid assembly of claim 1, wherein the first guide track is elongated and has a portion sized and shaped to slidably receive and retain the first guide member therein, and the second guide track is elongated and has a portion sized and to slidably receive and retain the second guide member therein as the sealing assembly is moved to change the lid assembly between the integrated and cleaning configurations.

14. The lid assembly of claim 1, wherein the first guide track is elongated with a first longitudinal end adjacent to the lid upper portion and a second longitudinal end spaced downwardly away from the first longitudinal end of the first guide track, the second guide track is elongated with a first longitudinal end adjacent to the lid upper portion and a second longitudinal end spaced downwardly away from the first longitudinal end of the second guide track, the first guide member is elongated with a first longitudinal end positioned adjacent to the first longitudinal end of the first guide track and a second longitudinal end positioned adjacent to the second longitudinal end of the first guide track when the first guide member is engaged with the first guide track and the lid assembly is in the integrated configuration, and the second guide member is elongated with a first longitudinal end positioned adjacent to the first longitudinal end of the second guide track and a second longitudinal end positioned adjacent to the second longitudinal end of the second guide track when the second guide member is engaged with the second guide track and the lid assembly is in the integrated configuration.

15. A lid assembly for a drinking vessel, comprising:

a lid main body having a lid upper portion provided with a drinking aperture, a first guide track extending in a downward direction away from the drinking aperture, and a sealing assembly catch;

a trigger assembly provided with a trigger portion and an actuating portion, the trigger portion configured to move the actuating portion when the trigger portion is pressed; and a removable sealing assembly moveable between an integrated position within the lid main body and a removed position out of and disconnected from the lid main body, including:

a sealing assembly body having a first guide member extending along a first axis of the sealing assembly body, and a sealing element aperture disposed on at least one of an upper portion of the sealing assembly body and a lower portion of the sealing assembly body, the first guide member and the first guide track having complementary interlocking curved cross-sectional shapes, and the first guide member being slidably engageable with the first guide track and slidable therealong for guiding movement of the seal assembly between the integrated and removed positions;

a sealing element including a drinking stopper on a first end of the sealing element, the sealing element being slidably movable back and forth relative to the sealing element aperture along the first axis between (i) a first position where the drinking stopper is spaced apart at a farthest distance away from the sealing assembly body, and (ii) a second position where the drinking stopper is a closest distance to the sealing assembly body; and a latching portion on the lower portion of the sealing assembly configured to engage with the sealing assembly catch, the sealing assembly being configured to be removably secured to the lid main body by engaging the first guide member of the sealing assembly with the first guide track of the lid main body, and engaging the latching portion with the sealing assembly catch when the sealing assembly is in the integrated position, and the actuating portion of the trigger assembly being selectively operable to move the sealing element between the first position and the second position when the sealing assembly is in the integrated position and secured to the lid main body.

16. The lid assembly of claim 15, wherein the lid main body further includes a second guide track extending in a downward direction in parallel to the first guide track, and the sealing assembly body further including a second guide member extending in parallel to the first guide member, the first guide track having a different size than the second guide track, the first guide member being sized to match the first guide track, the second guide member being sized to match the second guide track, and the sealing assembly being further configured to be removably secured to the lid main body by engaging the second guide member of the sealing assembly with the second guide track of the lid main body.

17. The lid assembly of claim 16, wherein the second guide member and the second guide track having complementary interlocking cross-sectional shapes, and the second guide member is slidably engageable with the second guide track and slidable therealong for guiding movement of the seal assembly between the integrated and removed positions.

18. The lid assembly of claim 15, wherein the first guide track is elongated with a first longitudinal end adjacent to the lid upper portion and a second longitudinal end spaced downwardly away from the first longitudinal end of the first guide track, and the first guide member is elongated with a first longitudinal end positioned adjacent to the first longitudinal end of the first guide track and a second longitudinal end positioned adjacent to the second longitudinal end of the first guide track when the first guide member is engaged with the first guide track and the sealing assembly is in the integrated position.

19. The lid assembly of claim 16, wherein the first guide track is elongated with a first longitudinal end adjacent to the lid upper portion and a second longitudinal end spaced downwardly away from the first longitudinal end of the first guide track, the second guide track is elongated with a first longitudinal end adjacent to the lid upper portion and a second longitudinal end spaced downwardly away from the first longitudinal end of the second guide track, the first guide member is elongated with a first longitudinal end positioned adjacent to the first longitudinal end of the first guide track and a second longitudinal end positioned adjacent to the second longitudinal end of the first guide track when the first guide member is engaged with the first guide track and the sealing assembly is in the integrated position, and the second guide member is elongated with a first longitudinal end positioned adjacent to the first longitudinal end of the second guide track and a second longitudinal end positioned adjacent to the second longitudinal end of the second guide track when the second guide member is engaged with the second guide track and the sealing assembly is in the integrated position.

20. A drinking container assembly, comprising:

a drinking vessel; and a lid assembly including:

a lid main body having a lid upper portion provided with a drinking aperture, a first guide track and a second guide track extending in a downward direction away from the drinking aperture;

a trigger assembly provided with a trigger portion and an actuating portion, the trigger portion configured to move the actuating portion when the trigger portion is pressed; and a removable sealing assembly provided with a sealing assembly body and a sealing element, the sealing assembly body having a first guide member and a second guide member, each extending along a first axis of the sealing assembly body, the sealing element having a drinking stopper on a first end, and the sealing element being slidably movable back and forth relative to the sealing assembly body along the first axis between (i) a first position where the drinking stopper is spaced apart at a farthest distance away from the sealing assembly body, and (ii) a second position where the drinking stopper is a closest distance to the sealing assembly body, the sealing assembly being removably secured to the lid main body when the lid assembly is in an integrated configuration and the sealing assembly being separated from the lid main body in a cleaning configuration, the integrated configuration being a configuration where the first guide member is retained by the first guide track, the second guide member is retained by the second guide track, and the actuating portion is positioned to move the sealing element between the first position where the drinking stopper seals the drink aperture and the second position where the drinking stopper is spaced apart from the drink aperture, the first guide member and the first guide track having complementary interlocking cross-sectional shapes and the second guide member and the second guide track having complementary interlocking cross-sectional shapes, the first guide member being slidably engageable with the first guide track and slidable therealong for guiding movement of the first guide member as the sealing assembly is moved to change the lid assembly between the integrated and cleaning configurations, and the second guide member being slidably engageable with second guide track and slidable therealong for guiding movement of the first guide member as the sealing assembly is moved to change the lid assembly between the integrated and cleaning configurations.

21. A lid assembly for a drinking vessel, comprising:

a lid main body having a lid upper portion provided with a drinking aperture, a first guide track and a second guide track extending in a downward direction away from the drinking aperture;

a trigger assembly provided with a trigger portion and an actuating portion, the trigger portion configured to move the actuating portion when the trigger portion is pressed; and a removable sealing assembly provided with a sealing assembly body and a sealing element, the sealing assembly body having a first guide member and a second guide member, each extending along a first axis of the sealing assembly body, the sealing element having a drinking stopper on a first end, and the sealing element being slidably movable back and forth relative to the sealing assembly body along the first axis between (i) a first position where the drinking stopper is spaced apart at a farthest distance away from the sealing assembly body, and (ii) a second position where the drinking stopper is a closest distance to the sealing assembly body, the sealing assembly being removably secured to the lid main body when the lid assembly is in an integrated configuration and the sealing assembly being separated from the lid main body in a cleaning configuration, the integrated configuration being a configuration where the first guide member is engaged with the first guide track, the second guide member is engaged with the second guide track, and the actuating portion is positioned to move the sealing element between the first position where the drinking stopper seals the drink aperture and the second position where the drinking stopper is spaced apart from the drink aperture, wherein the first guide member is a different size than the second guide member of the sealing assembly, and the first guide track of lid main body is a different size than the second guide track of the lid main body, the first guide member being sized and shaped to match at least one of a size and a shape of the first guide track, and the second guide member being sized and shaped to match at least one of a size and a shape of the second guide track.

22. A lid assembly for a drinking vessel, comprising:

a lid main body having a lid upper portion provided with a drinking aperture, a first guide track and a second guide track extending in a downward direction away from the drinking aperture;

a trigger assembly provided with a trigger portion and an actuating portion, the trigger portion configured to move the actuating portion when the trigger portion is pressed; and a removable sealing assembly provided with a sealing assembly body and a sealing element, the sealing assembly body having a first guide member and a second guide member, each extending along a first axis of the sealing assembly body, the sealing element having a drinking stopper on a first end, and the sealing element being slidably movable back and forth relative to the sealing assembly body along the first axis between (i) a first position where the drinking stopper is spaced apart at a farthest distance away from the sealing assembly body, and (ii) a second position where the drinking stopper is a closest distance to the sealing assembly body, the sealing assembly being removably secured to the lid main body when the lid assembly is in an integrated configuration and the sealing assembly being separated from the lid main body in a cleaning configuration, the integrated configuration being a configuration where the first guide member is engaged with the first guide track, the second guide member is engaged with the second guide track, and the actuating portion is positioned to move the sealing element between the first position where the drinking stopper seals the drink aperture and the second position where the drinking stopper is spaced apart from the drink aperture, wherein the sealing assembly body including a base portion from which at least one of the first guide member and the second guide member extend, the base portion abutting a lowermost end of at least one of the first guide track and the second guide track when the lid assembly is in the integrated configuration.

23. A lid assembly for a drinking vessel, comprising:

a lid main body having a lid upper portion provided with a drinking aperture, a first guide track and a second guide track extending in a downward direction away from the drinking aperture;

a trigger assembly provided with a trigger portion and an actuating portion, the trigger portion configured to move the actuating portion when the trigger portion is pressed;

a removable sealing assembly provided with a sealing assembly body and a sealing element, the sealing assembly body having a first guide member and a second guide member, each extending along a first axis of the sealing assembly body, the sealing element having a drinking stopper on a first end, and the sealing element being slidably movable back and forth relative to the sealing assembly body along the first axis between (i) a first position where the drinking stopper is spaced apart at a farthest distance away from the sealing assembly body, and (ii) a second position where the drinking stopper is a closest distance to the sealing assembly body, the sealing assembly being removably secured to the lid main body when the lid assembly is in an integrated configuration and the sealing assembly being separated from the lid main body in a cleaning configuration, the integrated configuration being a configuration where the first guide member is engaged with the first guide track, the second guide member is engaged with the second guide track, and the actuating portion is positioned to move the sealing element between the first position where the drinking stopper seals the drink aperture and the second position where the drinking stopper is spaced apart from the drink aperture;

a support lip disposed on the lid main body; and a latching portion disposed on the sealing assembly body, the latching portion being configured to engage with the support lip to removably secure the sealing assembly to the lid main body in the integrated configuration.

24. A lid assembly for a drinking vessel, comprising:

a lid main body having a lid upper portion provided with a drinking aperture, a first guide track extending in a downward direction away from the drinking aperture, and a sealing assembly catch;

a trigger assembly provided with a trigger portion and an actuating portion, the trigger portion configured to move the actuating portion when the trigger portion is pressed;

a removable sealing assembly including:

a sealing assembly body having a first guide member extending along a first axis of the sealing assembly body, and a sealing element aperture disposed on at least one of an upper portion of the sealing assembly body and a lower portion of the sealing assembly body;

a sealing element including a drinking stopper on a first end of the sealing element, the sealing element being slidably movable back and forth relative to the sealing element aperture along the first axis between (i) a first position where the drinking stopper is spaced apart at a farthest distance away from the sealing assembly body, and (ii) a second position where the drinking stopper is a closest distance to the sealing assembly body; and a latching portion on the lower portion of the sealing assembly configured to engage with the sealing assembly catch, the sealing assembly being configured to be removably secured to the lid main body by engaging the first guide member of the sealing assembly with the first guide track of the lid main body, and engaging the latching portion with the sealing assembly catch, and the actuating portion of the trigger assembly being selectively operable to move the sealing element between the first position and the second position when the sealing assembly is secured to the lid main body; and wherein the lid main body further includes a second guide track extending in a downward direction in parallel to the first guide track, and the sealing assembly body further including a second guide member extending in parallel to the first guide member, the first guide track having a different size than the second guide track, the first guide member being sized to match the first guide track, the second guide member being sized to match the second guide track, and the sealing assembly being further configured to be removably secured to the lid main body by engaging the second guide member of the sealing assembly with the second guide track of the lid main body.

25. A lid assembly for a drinking vessel, comprising:

a lid main body having a lid upper portion provided with a drinking aperture, a first guide member and a second guide member extending in a downward direction away from the drinking aperture;

a trigger assembly provided with a trigger portion and an actuating portion, the trigger portion configured to move the actuating portion when the trigger portion is pressed; and a removable sealing assembly provided with a sealing assembly body and a sealing element, the sealing assembly body having a third guide member and a fourth guide member, each extending along a first axis of the sealing assembly body, the sealing element having a drinking stopper on a first end, and the sealing element being slidably movable back and forth relative to the sealing assembly body along the first axis between (i) a first position where the drinking stopper is spaced apart at a farthest distance away from the sealing assembly body, and (ii) a second position where the drinking stopper is a closest distance to the sealing assembly body, the sealing assembly being removably secured to the lid main body when the lid assembly is in an integrated configuration and the sealing assembly being separated from the lid main body in a cleaning configuration, the integrated configuration being a configuration where the first guide member and the third guide member are in guiding engagement, the second guide member and the fourth guide member are in guiding engagement, and the actuating portion is positioned to move the sealing element between the first position where the drinking stopper seals the drink aperture and the second position where the drinking stopper is spaced apart from the drink aperture, the first and third guide members being in sliding engagement for guiding movement of the third guide member as the sealing assembly is moved to change the lid assembly between the integrated and cleaning configurations, and the second and fourth guide members being sliding engagement for guiding movement of the fourth guide member as the sealing assembly is moved to change the lid assembly between the integrated and cleaning configurations.

26. The lid assembly of claim 25, wherein one of the first guide member and third guide member is an elongated first channel guidably receiving the other of the first guide member and third guide member therein and shaped to guide the third guide member along a linear path, and one of the second guide member and fourth guide member is an elongated second channel guidably receiving the other of the second guide member and fourth guide member therein and shaped to guide the fourth guide member along a linear path as the sealing assembly is moved to change the lid assembly between the integrated and cleaning configurations.

27. The lid assembly of claim 26, wherein the first channel has an elongated first recess sized to receive and retain therein against off-axis movement the other of the first guide member and third guide member therein, and the second channel has an elongated second recess sized to receive and retain therein against off-axis movement the other of the second guide member and fourth guide member therein, the first recess having an elongated laterally inward opening through which the other of the first guide member and third guide member extends and the second recess having an elongated laterally inward opening through which the other of the second guide member and fourth guide member extends.

28. The lid assembly of claim 26, wherein the first, second, third and fourth guide members are rigid to reduce off-axis movement of the sealing assembly as the sealing assembly is moved to change the lid assembly between the integrated and cleaning configurations.

* * * * *